United States Patent [19]

Saito et al.

[11] Patent Number: 4,949,778

[45] Date of Patent: Aug. 21, 1990

[54] IMMERSION NOZZLE FOR CONTINUOUS CASTING

[75] Inventors: Kenji Saito; Tsutomu Nozaki, both of Chiba; Yukio Oguchi, Ako; Kenichi Sorimachi, Kurashiki; Hakaru Nakato, Chiba; Haruji Okuda, Kurashiki; Koji Hosotani, Chiba; Katsuo Kinoshita, Tokyo; Kenji Murata, Chiba, all of Japan

[73] Assignee: Kawasaki Steel Corporation, Kobe City, Japan

[21] Appl. No.: 283,789

[22] Filed: Dec. 13, 1988

[30] Foreign Application Priority Data

Dec. 16, 1987 [JP] Japan ..... 62-316144
Dec. 28, 1987 [JP] Japan ..... 62-329744
Dec. 28, 1987 [JP] Japan ..... 197265

[51] Int. Cl.[5] ..... B22D 11/00

[52] U.S. Cl. ..... 164/468; 164/488; 164/437; 164/337; 222/591

[58] Field of Search ..... 164/437, 488, 337, 466, 164/468; 222/590, 591

[56] References Cited

U.S. PATENT DOCUMENTS 3,371,704 3/1968 Astrov et al. ..... 164/437
4,495,984 1/1985 Kolberg ..... 164/488

FOREIGN PATENT DOCUMENTS 202143 11/1984 Japan ..... 164/488
193755 8/1986 Japan ..... 164/488
226149 10/1986 Japan ..... 164/437
235813 5/1945 Switzerland ..... 164/437
588059 1/1978 U.S.S.R. ..... 164/437

OTHER PUBLICATIONS

Patent Abstracts of Japan, vol. 10, No. 174 M-490 [2230], 19th Jun. 1986, & JP-A-61 23 558 (NIPPON KOKAN K. K.) 01-02-1986.

Patent Abstracts of Japan, vol. 12, No. 340(M-740)[3187], 13th Sep. 1988; & JP-A-63 101 058 (KAWASAKI STEEL CORP.) 06-05-1988.

Patent Abstracts of Japan, vol. 6, No. 199 (M-162)[1077], 8th Oct. 1982; & JP-A-57 106 456 (KAWASAKI SEITETSU K. K.) 02-07-1982.

Patent Abstracts of Japan, vol. 10, No. 265 (M-515)[2321], 10th Sep. 1985; & JP-a-61 88 952 (KAWASAKI STEEL CORP.) 07-05-1986.

*Primary Examiner*—Nicholas P. Godici
*Assistant Examiner*—Edward A. Brown
*Attorney, Agent, or Firm*—Balogh, Osann, Kramer, Dvorak, Genova & Traub

[57] ABSTRACT

In an immersion nozzle for continuous casting, at least one portion of reduced a sectional area of passage for molten metal is formed near to the bottom of the nozzle and plural discharge ports symmetrically arranged with respect to the axis of the nozzle are arranged above and below the reduced sectional area portion in the longitudinal direction of the nozzle. Further, molten metal is continuously cast by using the above immersion nozzle together with a static magnetic field.

6 Claims, 7 Drawing Sheets

IMMERSION NOZZLE FOR CONTINUOUS CASTING

BACKGROUND OF THE INVENTION

1. Field of the Invention

This invention relates to an immersion nozzle for continuously casting molten metal, particularly clean molten steel having less non-metallic oxide inclusions, bubbles and powdery inclusions and a method of continuously casting molten metal by using this immersion nozzle.

2. Related Art Statement

In the continuous casting of molten steel, the immersion nozzle has hitherto been used when molten steel is poured from a tundish into a mold. A typical example of this immersion nozzle is shown in FIG. 1, wherein the sectional area of the passage for passing molten steel through the immersion nozzle 1 is designed to become smaller than the total area of discharge ports formed in the opposite sides of the immersion nozzle 1 from a viewpoint of the restriction on the size of the mold for continuously casting into a slab (including bloom, beam blank, billet and the like). Therefore, when molten steel flowing down through the passage of the immersion nozzle at a high speed is discharged from the wide discharge port into the mold, the down component of the molten steel stream remains in the mold, non-metallic inclusions such as alumina and the like and bubbles entered with the down-flow molten steel deeply penetrate into molten steel and are trapped by the resulting solidification shell to degrade the quality of the continuously cast slab. In the curved-type continuously casting machine, there is particularly caused a problem that the non metallic inclusions and bubbles once deeply caught in molten steel are trapped below the lower surface of the solidification shell without floating up to meniscus portion and generate drawbacks such as slivers, blisters and the like on the surface of the steel product such as sheet and pipe after rolling.

As a countermeasure for preventing the occurrence of the down-flow component of molten steel stream, there are mentioned the following.

It is considered to make the area of the discharge port small in the immersion nozzle. In this case, however, the discharge speed of molten steel becomes large. As a result, molten steel discharged from the immersion nozzle collides to the narrow side of the mold to be changed into a down flow thereof and consequently there is a possibility that the non-metallic inclusions such as alumina and the like and bubbles are trapped by the solidification shell, resulting in the degradation of the quality of steel product.

Further, it is considered to arrange a regulating vane for stopping the down-flow component of molten steel stream. However, there is a problem that the regulating vane is not durable to the flowing of high-temperature molten steel at high speed.

Moreover, it is considered to make large the sectional area of the passage for molten steel in the immersion nozzle. In this case, however, the thickness of the mold is restricted, so that it is difficult to charge molten steel into a portion between the mold and the outer surface of the immersion nozzle.

In order to solve the above problems, Japanese Patent laid open No. 61-23558 and Japanese Utility Model laid open No. 55-88347 disclose a technique for preventing the penetration of molten steel stream into un solidified region by improving the immersion nozzle.

FIG. 2 shows an immersion nozzle 2 described in Japanese Patent laid open No. 61-23558 wherein the bottom of the nozzle is curved in semi-spherical form and three or more discharge ports 3 per one side of the nozzle are formed therein for discharging molten steel. FIG. 3 shows an immersion nozzle 4 described in Japanese Utility Model laid open No. 55-88347, wherein two discharge ports 5 opposed to each other and opening in a horizontal or obliquely upward direction are arranged in the lower end portion of the nozzle and two discharge ports 6 opening in an obliquely downward direction are arranged just above the ports 5, whereby streams of molten steel discharged from these ports are collided with each other.

In these immersion nozzles, however, as the flowing speed of molten steel through the inside of the nozzle becomes larger, molten steel is discharged from only the ports at the lower end portion of the nozzle, so that there is a problem that the down flowing of molten steel stream is accelerated to make large the penetration depth of molten steel. On the other hand, there is a fear that negative pressure is generated at the upper discharge ports and mold powder is absorbed in molten steel to undesirably increase the amount of powdery inclusion.

SUMMARY OF THE INVENTION

It is, therefore, an object of the invention to solve the aforementioned drawbacks of the conventional immersion nozzles that the penetration depth of molten steel into the cast slab is deep and it is difficult to completely prevent the catching of non-metallic inclusions and to provide an immersion nozzle for continuous casting which can prevent the occurrence of the down-flow component of molten steel stream to avoid the catching of the non-metallic inclusions and bubbles by the cast slab and can uniformize the discharging speed of molten steel stream from the discharge port to promote the floating of bubbles and non-metallic inclusions and produce cast slabs having less defects.

It is another object of the invention to provide a method of continuously casting molten steel wherein molten steel is uniformly discharged from upper and down discharge ports in the above immersion nozzle to prevent the occurrence of strong down component of molten steel stream and at the same time make the molten steel stream uniform by static magnetic field.

According to a first aspect of the invention, there is the provision of an immersion nozzle for continuous casting, characterized in that at least one portion of reduced sectional area of a passage for molten metal is formed in an immersion nozzle near to the bottom of the nozzle and plural discharge ports symmetrically arranged with respect to the axis of the nozzle are arranged above and below the reduced sectional area portion in the longitudinal direction of the nozzle.

According to a second aspect of the invention, there is the provision of a method of continuously casting by continuously feeding molten metal to a mold through an immersion nozzle and drawing a cast product from a lower end of the mold, characterized in that a static magnetic field device is arranged in the mold to excite a static magnetic field between the immersion nozzle and the inner wall face of the mold and molten metal is fed through the immersion nozzle wherein at least one portion of reduced sectional area of a passage for molten metal is formed in the immersion nozzle near to the bottom of the nozzle and plural discharge ports symmetrically arranged with respect to the axis of the nozzle are arranged above and below the sectional area reducing portion in the longitudinal direction of the nozzle.

DESCRIPTION OF THE PREFERRED EMBODIMENTS

The inventors have found from various experiments that when plural discharge ports are merely arranged at two stages in the longitudinal direction, the strong discharging of molten steel is caused at the lower discharge port and the discharging amount of molten steel is small at the upper discharge port. In this connection, the inventors have confirmed that in order to prevent the above phenomenon, the balance of the discharging amount between the upper discharge port and the lower discharge port in the immersion nozzle is obtained by narrowing the molten steel passage at a position near to the lower end portion of the immersion nozzle. Further, it is ascertained that when the area of the upper discharge port is approximately equal to that of the lower discharge port, it is effective that the sectional area of the molten steel passage for the lower discharge port is not more than 0.9 to the sectional area of the molten steel passage for the upper discharge port.

When many discharge ports are arranged in the longitudinal direction of the immersion nozzle, the uppermost discharge ports become near to the meniscus, so that there are caused problems such as fluctuation of molten steel surface and the like. Therefore, the number of discharge ports arranged in the longitudinal direction of the immersion nozzle is 3 at maximum. In this case, it is effective to gradually reduce the sectional area of the molten steel passage toward the lower end of the immersion nozzle.

Further, when the sectional area of the lower discharge port is made larger than that of the upper discharge port, the stream of molten steel collided on the bottom of the immersion nozzle is stably discharged from the lower discharge port. Moreover, it is preferable that the total sectional area of the discharge ports is not less than twice the sectional area of the molten steel passage. Because, when the total sectional area of the discharge ports is less than twice of the sectional area of the passage, the discharging rate of molten steel from the discharge ports becomes large and the down-flow component of molten steel stream becomes large and deeply penetrates into the mold.

The first embodiment of the immersion nozzle according to the invention will be described in detail with reference to FIG. 4.

Figure 4A:
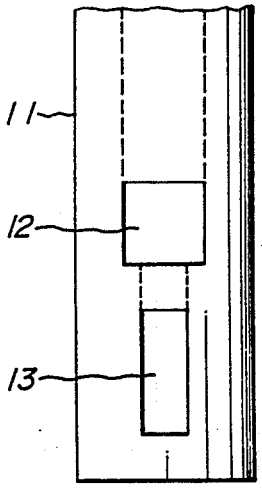
FIGS. 4*a* to 4*c* are front, side and sectional views of an embodiment of the immersion nozzle according to the invention, respectively.
Figure 4B:
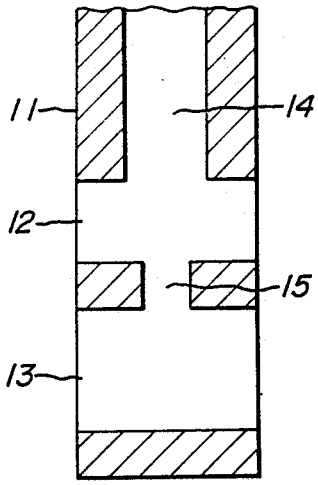
Figure 4C:
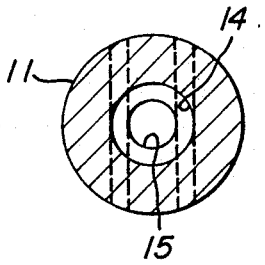

In the embodiment of FIG. 4, the immersion nozzle 11 is provided with two discharge ports 12, 13 at two stages in the longitudinal direction of the nozzle. The discharge ports 12, 13 are arranged above and below the border of a portion 15 located near to the bottom of the nozzle and having a sectional area smaller than that of a molten steel passage 14.

Figure 5:
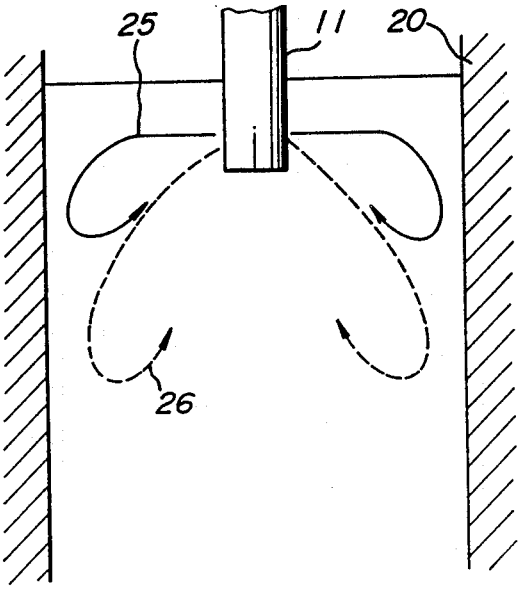
FIG. 5 is a diagrammatical view illustrating a flowing state of molten metal in the mold when using immersion nozzles according to the invention and conventional technique.

In FIG. 5 is shown a flowing state of molten steel in a mold 20 when molten steel is poured into the mold 20 through the immersion nozzle 11 in which the sectional area of the passage 14 is a and the total sectional area of the discharge ports 12, 13 is about 3·a.

Moreover, a solid line 25 shows the flowing state of molten steel when using the immersion nozzle 11, and dotted lines 26 show the flowing state of molten steel when using the conventional immersion nozzle. As seen from FIG. 5, when using the immersion nozzle according to the invention, the down flow component of molten steel stream is not so strong, and also the discharging speed of molten steel at the lower discharge port 13 is about a half of the conventional technique.

In the immersion nozzle 11 shown in FIG. 4, there is a possibility that the stream of molten steel is not necessarily discharged at a uniform discharging rate from each of the discharge ports 12, 13 in connection with the area of the discharge port and the sectional area of the molten steel passage. If molten steel is discharged only from the lower discharge ports, the down-flow component becomes strong and deeply penetrates into the inside of the resulting cast slab, while if molten steel is discharged only from the upper discharge ports, the fluctuation of molten steel surface becomes violent and the catching of mold powder occurs. Therefore, in order to prevent these problems, it is important to discharge molten steel at a uniform discharging rate from each of the discharge ports.

In this connection, the inventors have made further studies and found out that the unbalance of molten steel stream discharged between the upper discharge port and the lower discharge port in the immersion nozzle results from the fact that the upper portion of the nozzle having a faster speed of molten steel stream passing through the passage is small in the static pressure according to Bernoulli's theorem. Therefore, it has been confirmed that the balance of molten steel stream between the upper discharge port and the lower discharge port is obtained by reducing the size of the passage at a portion near to the bottom of the nozzle in the longitudinal direction of the nozzle so as to satisfy a certain relation between sectional area of discharge port and sectional area of passage.

In the preferred embodiment of the immersion nozzle according to the invention, the sectional area of each of the discharge ports ($h_1, h_2, \ldots, h_n$ in a descending scale) and the sectional area of each molten steel passage corresponding to the respective discharge port ($S_1, S_2, \ldots, S_n$ in a descending scale) satisfy the following relations:

$$K^2\left[\frac{S_2}{S_1}\right]^3 = \left[\frac{h_2 + \ldots + h_n}{h_1 + h_2 + \ldots + h_n}\right]^2 \quad (1)$$

$$\left[\frac{S_3}{S_2}\right]^3 = \left[\frac{h_3 + \ldots + h_n}{h_2 + h_3 + \ldots + h_n}\right]^2 \quad (2)$$

$$\vdots$$

$$\left[\frac{S_n}{S_{n-1}}\right]^3 = \left[\frac{h_n}{h_{n-1} + h_n}\right]^2 \quad (n)$$

$$0.7 \leqq K \leqq 1.0$$

Figure 6A:
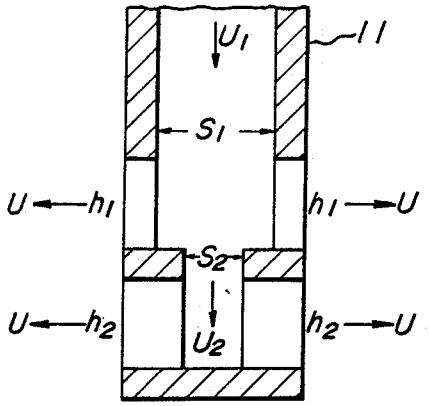
FIGS. 6*a* and 6*b* are schematic views of another preferable embodiment of the immersion nozzle according to the invention illustrating calculation means for areas of discharge port and passage.
Figure 6B:
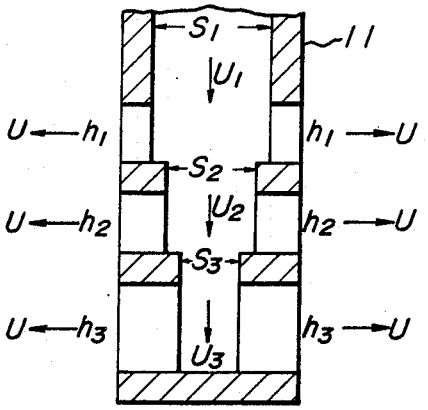

The above relations are introduced as follows:

The area of molten steel passage, area of discharge port and flowing speed of molten steel in the immersion nozzle according to the invention are shown by respective symbols in FIG. 6. Moreover, the driving force for discharging molten steel from the upper discharge port is a dynamic pressure generated at the size-reducing portion of the passage. In case of two-stage discharge port (FIG. 6*a*):

Equation of continuity $$\begin{cases} S_1U_1 = 2K'\,h_1U + KS_2U_2 & \text{(i)} \\ KS_2U_2 = 2K'\,h_2U & \text{(ii)} \end{cases}$$

Bernoulli's equation $$\tfrac{1}{2}\rho U_1^2 = \tfrac{1}{2}\rho U_2^2 + P \quad \text{(iii)}$$

Balance of pressure $$P = \frac{S_1 - S_2}{S_1} \cdot \tfrac{1}{2} \cdot \rho U_1^2 \quad \text{(iv)}$$

From the equations (i) to (iv), $$\left[\frac{h_2}{h_1 + h_2}\right]^2 = K^2 \cdot \left[\frac{S_2}{S_1}\right]^3 \quad \text{(v)}$$

In case of three-stage discharge port (FIG. 6*b*):

Equation of continuity $$\begin{cases} S_1U_1 = 2K'\,h_1U + KS_2U_2 & \text{(vi)} \\ KS_2U_2 = 2K'\,h_2U + KS_3U_3 & \text{(vii)} \\ KS_3U_3 = 2K'\,h_3U & \text{(viii)} \end{cases}$$

Bernoulli's equation $$\tfrac{1}{2}\rho U_1^2 = \tfrac{1}{2}\rho U_2^2 + P_1 \quad \text{(ix)}$$

Balance of pressure $$\begin{cases} P_1 = \dfrac{S_1 - S_2}{S_1} \cdot \tfrac{1}{2} \cdot \rho U_1^2 & \text{(X)} \\ \tfrac{1}{2}\rho U_2^2 = \tfrac{1}{2}\rho U_3^2 + P_2 & \text{(xi)} \\ P_2 = \dfrac{S_2 - S_3}{S_2} \cdot \tfrac{1}{2} \cdot \rho U_2^2 & \text{(Xii)} \end{cases}$$

From the equations (vi) to (xii), $$K^2\left[\frac{S_2}{S_1}\right]^3 = \left[\frac{h_2 + h_3}{h_1 + h_2 + h_3}\right]^2 \quad \text{(xiii)}$$

$$\left[\frac{S_3}{S_2}\right]^3 = \left[\frac{h_3}{h_2 + h_3}\right]^2 \quad \text{(xiv)}$$

The relation between the area of the discharge port and the area of the passage is determined from the above equations.

Moreover, the number of the discharge ports may be four or more stages. In this case, there is caused a fear that the uppermost discharge port approaches to the meniscus to increase the fluctuation of molten steel surface. Therefore, according to the invention, the number of the discharge ports is 2 or 3 stages.

In the above equations, K and K′ are discharge coefficients in the longitudinal and lateral directions, respectively. Strictly speaking, the values of K and K′ are different in each of the discharge ports, but it can be supposed that the discharge coefficient in longitudinal direction K and the discharge coefficient in lateral direction K′ are approximately constant.

The discharge coefficient K is experimentally about 0.8. Even when the sectional area of each passage deviates from the ideal condition satisfying the equations (xiii) and (xiv), it is practically acceptable, and the condition of $0.7 \leqq K \leqq 1$ is an accepted preferable range in the invention. The reasonable range shown by the oblique line in FIG. 7 indicates a relation between the area ratio of discharge ports and sectional area ratio of passages for obtaining $0.7 \leqq K \leqq 1$. In the designing of the immersion nozzle, the sectional area ratio of discharge ports and the sectional area ratio of passages may be set so as to satisfy the above reasonable range.

In case of two stage discharge ports, when the areas $h_1$ and $h_2$ of the discharge ports are previously set, the sectional area ratio of the molten steel passages is determined from $[h_2/h_1+h_2]^2=K^2[S_2/S_1]^3$. Since the sectional area of the molten steel passage is restricted by the size of the nozzle, when $S_1$ is predetermined within an acceptable range, $S_2$ is calculated.

In case of three stage discharge ports, the areas $h_1$, $h_2$ and $h_3$ of the discharge ports are previously set. Then, the sectional area ratio of the lower two stage passages is determined from $[S_3/S_2]^3=[h_3/h_2+h_3]^2$, and $S_2$ is calculated when $S_3$ is predetermined in accordance with the size of the nozzle. And also, the sectional area $S_1$ is determined by putting the above calculated $h_1$, $h_2$, $h_3$, and $S_2$ into the equation of $K^2[S_2/S_1]^3=[h_2+h_3/h_1+h_2+h_3]^2$.

Figure 7:
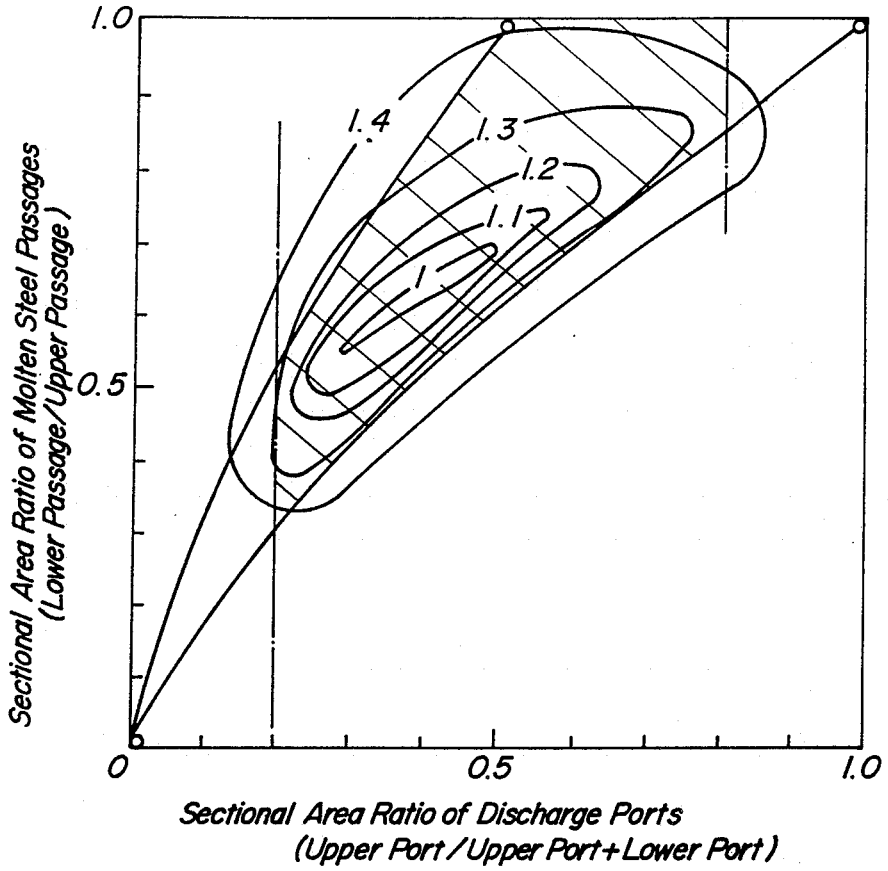
FIG. 7 is a graph showing reasonable ranges of area ratio of discharge ports and area ratio of passages.

The above calculated ranges of sectional area ratio of discharge ports (upper/upper+lower) and sectional area ratio of molten steel passages (lower/upper) uniforming the discharging speed from each of the discharge ports are a range sandwiched by solid lines in FIG. 7. As a result of inspection on a water model, when the area of the upper or lower discharge port becomes considerably small, an increase of displacing flow and negative pressure region is caused, so that the uniformity of the discharging speed can not be held if the sectional area ratio of the discharge ports (upper-/upper+lower) is not within a range of 0.2–0.8. For this end, the reasonable range is a range defined by oblique lines in FIG. 7. Moreover, a contour of ratio of maximum discharging speed at the lower and upper discharge ports is shown in FIG. 7. The oblique line portion is substantially existent in the contour of maximum discharging speed of 1.4.

Figure 8:
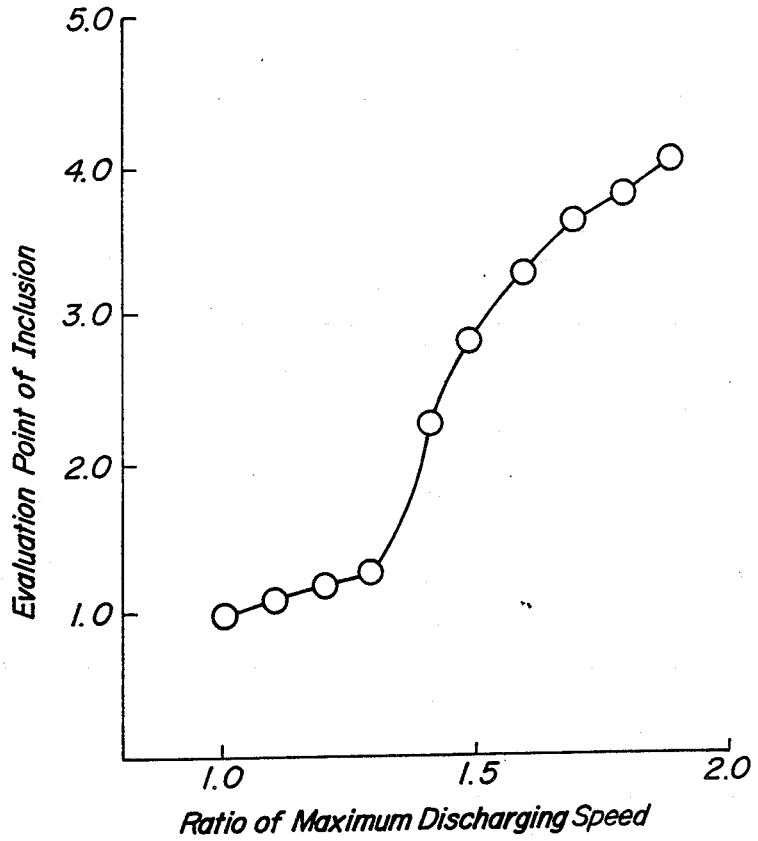
FIG. 8 is a graph showing a relationship between maximum discharging speed ratio of immersion nozzle and evaluation point of inclusion.

In FIG. 8 is shown the evaluation of inclusions detected in the resulting slab when molten steel is poured into a mold at a through put of 1.5 m/min through an immersion nozzle having a sectional area of discharge port corresponding to 1.7 times of the conventional nozzle and a ratio of maximum discharging speed of 1.0–1.9 at upper and lower discharge ports. As seen from FIG. 8, when the ratio of maximum discharging speed is more than 1.4, the number of inclusions increases. Moreover, the evaluation point of inclusions in the conventional immersion nozzle is 5.0.

Figure 9:
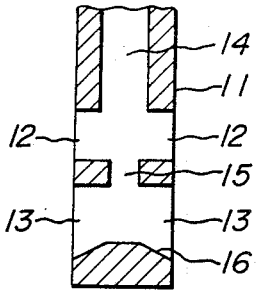
FIG. 9 is a side view of the other embodiment of the immersion nozzle according to the invention.

In the other preferable embodiment of the immersion nozzle according to the invention, the bottom face 16 of the nozzle 11 facing the lower discharge port 13 is inclined downward at an angle of 5°–50° in its both side end portions as shown in FIG. 9, whereby the nonmetallic inclusions and bubbles are separated from the main stream of molten steel discharged and the deep penetration thereof into the slab is effectively prevented.

That is, when the bottom face 16 has a downward angle of 5°–50°, the inclusions and bubbles are gathered in a low pressure portion above the lower discharge port and floated upward for the separation. On the other hand, the inclusions and bubbles discharged out with molten steel stream from the upper discharge port float upward during the discharging in the horizontal direction or collide onto the narrow side portion of the mold and float upward together with the upward stream, so that they are not harmful.

The reason why the downward angle of the bottom face is limited to a range of 5° to 50° is due to the fact that when the downward angle is less than 5°, the low pressure portion may be formed above the lower discharge port, while when it exceeds 50°, the down flow is strong and the bubbles and non metallic inclusions deeply penetrate into molten steel.

Figure 10:
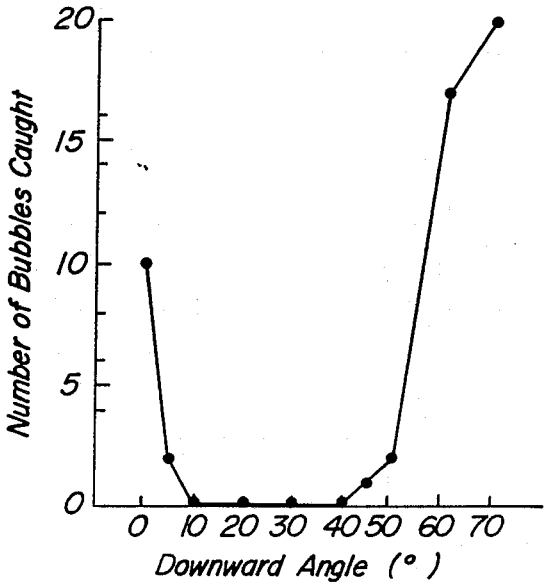
FIG. 10 is a graph showing a relationship between the down angle of the nozzle bottom face at the lower discharge port and number of bubbles caught.

FIG. 10 shows a relation between the downward angle of the bottom face and the number of bubbles caught after the water model experiment. In this case, the number of bubbles caught means number of bubbles having a diameter of not less than 2 mm caught in molten steel located downward at a position of 30 cm from the discharge port. The effect of the formation of a downward angle is obvious from the results of FIG. 10.

Further, the inventors have found the following when molten steel is continuously cast in a static magnetic field by using the aforementioned immersion nozzle.

Figure 11:
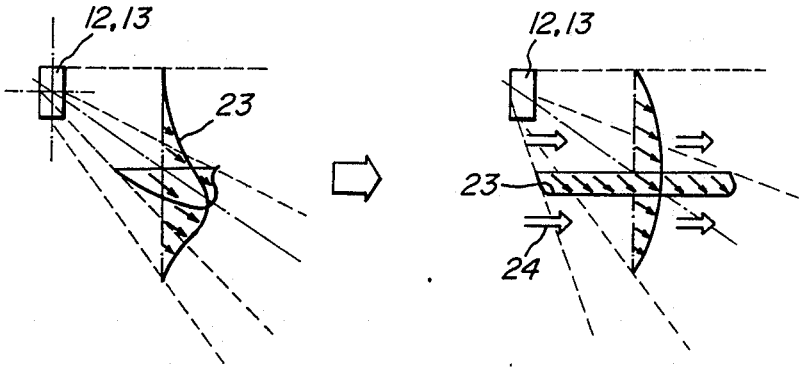
FIG. 11 is a diagrammatical view showing the expanse of discharged molten metal stream and flowing speed distribution in a magnetic field.

(1) When the discharged stream of molten steel is put into the static magnetic field, it spreads only in a plane parallel to the magnetic field and is decelerated as shown in FIG. 11. Therefore, if it is intended to manufacture the discharge port having a long length in the longitudinal direction, the spreading region is widened and the deceleration effect is large.

(2) Since the deceleration and dispersion actions to the discharged stream in the static magnetic field are an interaction between the magnetic field and the stream, when the stream is too fast, it passes through the magnetic field region in a short time, and the effect is small. Therefore, in order to make the effect of the static magnetic field large, it is necessary to reduce the discharging speed from the discharge port in the immersion nozzle.

(3) By using the immersion nozzle according to the invention, the balance of molten steel stream is obtained between the adjoining discharge ports.

Figure 12:
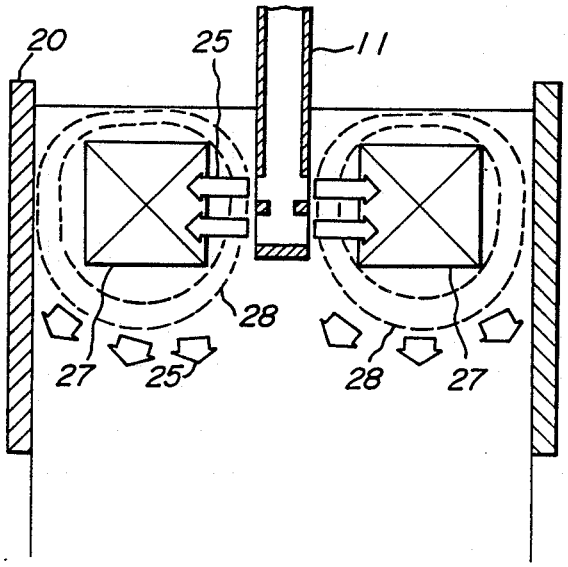
FIG. 12 is a diagrammatical view showing the structure of main parts of the mold according to the invention.

In FIG. 12 is shown a model of molten steel stream in the method according to the invention. In this case, molten steel discharged from the immersion nozzle 11 is cast while the discharged stream 25 is controlled by static magnetic field 28 generated from at least one pair of static magnet poles 27 arranged in the wide width face of the mold 20. When the casting is carried out by using the immersion nozzle 11, the width of the magnet pole in such an arrangement of static magnet poles is preferable to be not more than $\frac{1}{4}$ of full width of the resulting slab W. If the width of the magnet pole is too large, the gradient portion of magnetic flux density becomes narrow and the eddy current hardly occurs to degrade the controlling effect. The magnetic force of the magnet pole is preferable to become stronger, but it is preferably not less than 1700 gauss at the practical throughput of 1~5.0 t/min.

In order to examine the effect of the invention, various cast slabs are produced under various conditions, during which the descending speed of molten steel stream at the narrow side portion located downward at 1.5 m from the meniscus is estimated from the dendrite inclination angle of the cast slab. The results are shown in the following Table 1 when the casting is carried out at a throughput of 3.0 t/min in the mold having a thickness of 220 mm and a width of 1350 mm. As seen from Table 1, the descending speed of molten steel is largely reduced by the combination of the immersion nozzle and static magnetic field application according to the invention, and finally the occurrence of defects in the continuously cast slab can be prevented.

TABLE 1

| Condition | Descending speed at narrow side |
|---|---|
| conventional nozzle (15° downward) | 25 cm/sec |
| conventional nozzle + application of static magnetic field | 18 cm/sec |
| nozzle according to the invention | 17 cm/sec |
| nozzle according to the invention + application of static magnetic field | 8 cm/sec |

The following examples are given in the illustration of the invention and are not intended as limitations thereof.

EXAMPLE 1

Figure 1A:
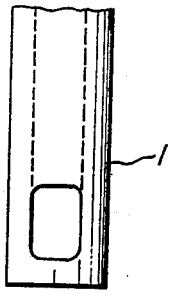
FIG 1a PRIOR ART
FIGS. 1 to 3 are schematical views illustrating various embodiments of the conventional immersion nozzle, respectively.
Figure 1B:
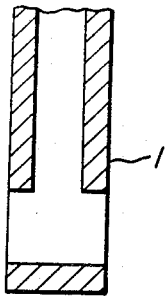
FIG 1b PRIOR ART
Figure 2A:
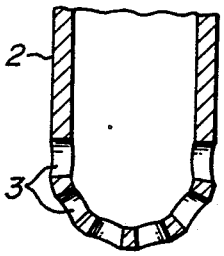
FIG 2a PRIOR ART
Figure 2B:
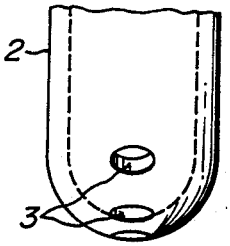
FIG 2b PRIOR ART

Into the experimental apparatus of actual size was charged a fluid containing 20 l/min of bubbles at a flowing rate of 400 l/min through the conventional immersion nozzle of FIG. 1 or the immersion nozzle of FIG. 4 according to the invention. As a result, the maximum catching depth of bubbles having a diameter of 1 mm was about 120 cm in the conventional immersion nozzle and about 105 cm in the immersion nozzle according to the invention.

Moreover, the above experiment was carried out under conditions that the sectional area of the discharge port in the conventional immersion nozzle was about 1.8 times of the sectional area of the molten steel passage thereof, while the sectional area of the discharge port in the immersion nozzle according to the invention was 3.0 times and the ratio of sectional area in the molten steel passage located at the lower discharge port to the molten steel passage located at the upper discharge port was 0.9.

EXAMPLE 2

The same experiment as in Example 1 was repeated by using the immersion nozzle in which the sectional area of the discharge port was the same as in the conventional immersion nozzle and the ratio of sectional area in the lower discharge port to the upper discharge port was 0.8. As a result, the stream of molten steel discharged from each of the discharge ports was substantially horizontal and the catching depth of bubbles having a diameter of 1 mm was about 95 cm.

In this case, the ratio of sectional area in the molten steel passage located at the lower discharge port to the molten steel passage located at the upper discharge port was 0.85.

EXAMPLE 3

The same experiment as in Example 1 was repeated by using the same immersion nozzle as in Example 2 except that the diameter of the molten steel passage at upper discharge port was 80 mm and the diameter of the molten steel passage at lower discharge port was 70 mm. As a result, the catching depth of bubbles having a diameter of 1 mm was about 91 cm.

EXAMPLE 4

Figure 3:
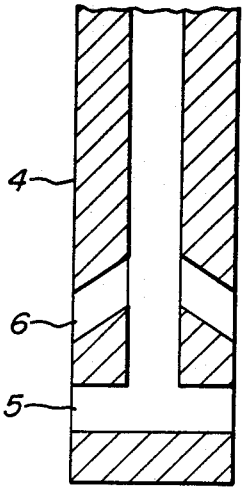
FIG 3 PRIOR ART

An immersion nozzle provided with two stage discharge ports according to the invention was prepared so as to satisfy the relation of the above equation (v) and used to produce a cast slab at a through put of 2.5 t/min or 4.0 t/min. Moreover, the discharging speed of each discharge port was previously measured by means of a Pito tube in water model. The evaluation of inclusions was made with respect to a specimen taken out from the resulting cast slab every heat to obtain results as shown in the following Table 2. For the comparison, the casting was carried out under the same conditions as mentioned above by using the conventional immersion nozzle shown in FIG. 3 as a comparative example, and then the same evaluation as mentioned above was repeated to obtain results as shown in Table 2.

TABLE 2

| | Sectional area ratio of lower passage to upper passage | Sectional area ratio of lower discharge port to upper discharge port | Discharge co-efficient (K) | Through put (t/min) | Maximum discharging speed ratio of lower discharge port to upper discharge port | Evaluation point of inclusion |
|---|---|---|---|---|---|---|
| Acceptable Example | 0.6 | 0.37 | 0.8 | 2.5 | 1.0 | 1.0 |
| | 0.8 | 0.61 | 0.85 | 2.5 | 1.27 | 1.35 |
| | 0.55 | 0.33 | 0.8 | 4.0 | 1.05 | 1.0 |
| | 0.75 | 0.55 | 0.85 | 4.0 | 1.20 | 1.15 |
| Comparative Example | 0.5 | 0.7 | 0.9 | 2.5 | 1.60 | 3.0 |
| | 1.0 | 0.5 | 0.8 | 2.5 | 1.90 | 4.0 |

As seen from the results of Table 2, the evaluation point of inclusions is reduced by half when using the immersion nozzle according to the invention, resulting in the effective improvement of the product quality.

EXAMPLE 5

Into the experimental apparatus of actual size was charged a fluid containing 20 l/min of bubbles at a flowing rate of 400 l/min through the conventional immersion nozzle of FIG. 1 or the immersion nozzle of FIG. 9 according to the invention. As a result, the maximum catching depth of bubbles having a diameter of 1 mm was about 120 cm in the conventional immersion nozzle and about 72 cm in the immersion nozzle according to the invention.

Moreover, the above experiment was carried out under conditions that the sectional area of the discharge port in the conventional immersion nozzle was about 1.8 times of the sectional area of the molten steel passage thereof, while the sectional area of the discharge port in the immersion nozzle according to the invention was 3.0 times and the ratio of sectional area in the molten steel passage located at the lower discharge port to the molten steel passage located at the upper discharge port was 0.8 and the downward angle of the bottom face 16 was 15°.

EXAMPLE 6

The same experiment as in Example 5 was repeated by using the immersion nozzle of FIG. 9 according to the invention having a downward angle of the bottom face of 35°. As a result, the maximum catching depth of bubbles having a diameter of 1 mm was about 68 cm.

When the immersion nozzles of Examples 5 and 6 were applied to the actual operation for the continuous casting, as shown in the following Table 3, the nonmetallic inclusions and bubbles are considerably reduced by using the immersion nozzle according to the invention.

TABLE 3

| | Nozzle form | Downward angle of bottom face | Index of inclusion | Index of bubble defect |
|---|---|---|---|---|
| Example 5 | FIG. 9 | 15° | 0.25 | 0.15 |
| Example 6 | FIG. 9 | 35° | 0.20 | 0.13 |
| Comparative Example | FIG. 1 | 0° | 1 | 1 |

EXAMPLE 7

An Al killed steel for cold rolling was cast at a throughput of 2.8~4.0 t/min by using the conventional immersion nozzle of FIG. 1 or the immersion nozzle of FIG. 4 in a curved type continuous slab caster of 220 mm in thickness and 1350~1500 mm in width having an arrangement of magnet poles shown in FIG. 12, in which the size of the magnet pole was 300 mm×300 mm and the magnetic flux density was 3500 gauss. In this case, the sectional area of the discharge port in the conventional immersion nozzle was about 1.8 times of the sectional area of the molten steel passage, while in the immersion nozzle according to the invention, the sectional area of the discharge port was 4.0 times and the ratio of sectional area in the molten steel passage located at the lower discharge port to the molten steel passage located at the upper discharge port was 0.8 and also the ratio of sectional area in the upper discharge port to the lower discharge port was 0.8. After the cold rolling of the resulting slab, the occurrence of sliver and blister was examined to obtain results as shown in the following Table 4.

TABLE 4

| Through put (t/min) | Example | | Comparative Example | |
|---|---|---|---|---|
| | Defect | | | |
| | sliver | blister | sliver | blister |
| 2.8~3.0 | none | none | none | none |
| 3.0~3.2 | none | none | slight | slight |
| 3.2~3.5 | none | none | slight | slight |
| 3.5~4.0 | none | none | frequently occurred | frequently occurred |

As seen from the results of Table 4, the occurrence of sliver and blister was not observed at the through put of up to 4.0 t/min in the immersion nozzle according to the invention. In the conventional immersion nozzle, the occurrence of slivers and blisters was observed at the throughput of not less than 3.0 t/min.

These results are sufficiently anticipated from the results of Table 1. Particularly, the effect of the invention becomes higher when the throughput is made large, so that the method according to the invention is advantageous in the continuous casting at high speed.

Although the invention has been described with respect to the immersion nozzle having a form and structure as shown in FIG. 4 or 9, it is naturally effective to box type or ellipsoid type immersion nozzles.

As mentioned above, according to the invention, the amount of powdery inclusions and non-metallic inclusions as well as bubbles caught into the inside of the continuously cast slab is reduced, whereby the quality of the slab is considerably improved.

What is claimed is:

1. An immersion nozzle having a molten steel passage for continuous casting, characterized in that at least one portion of reduced sectional area of passage for molten metal is formed in said immersion nozzle near to the bottom of the nozzle and plural discharge ports symmetrically arranged with respect to a longitudinal axis of the nozzle are arranged above and below said one portion in the longitudinal direction of the nozzle, wherein a total sectional area of said discharge ports is not less than twice the sectional area of said molten steel passage.

2. The immersion nozzle according to claim 1, wherein the number of discharge ports arranged in the longitudinal direction of the nozzle is 3 at maximum.

3. The immersion nozzle according to claim 1, wherein when the number of discharge ports arranged in the longitudinal direction of the nozzle is 2 and the sectional area of said upper discharge port is approximately equal to that of said lower discharge port, a ratio of sectional area of molten steel passage located at the lower discharge port to sectional area of molten steel passage at the upper discharge port is not more than 0.9.

4. The immersion nozzle according to claim 1, wherein the sectional area of each of the discharge ports ($h_1, h_2, \ldots, h_n$ in a descending scale) and the sectional area of each molten steel passage corresponding to the respective discharge port ($S_1, S_2, \ldots, S_n$ in a descending scale) satisfy the following relations:

$$K^2\left[\frac{S_2}{S_1}\right]^3 = \left[\frac{h_2 + \ldots + h_n}{h_1 + h_2 + \ldots + h_n}\right]^2 \quad (1)$$

$$\left[\frac{S_3}{S_2}\right]^3 = \left[\frac{h_3 + \ldots + h_n}{h_2 + h_3 + \ldots + h_n}\right]^2 \quad (2)$$

$$\vdots$$

$$\left[\frac{S_n}{S_{n-1}}\right]^3 = \left[\frac{h_n}{h_{n-1} + h_n}\right]^2 \quad (n)$$

$$0.7 \leqq K \leqq 1.0$$

(wherein K is a discharge coefficient).

5. The immersion nozzle according to claim 1, wherein a bottom face of said nozzle facing said lower discharge port has a downward inclination angle of 5° to 50° with respect to a transverse axis of said nozzle.

6. A method of continuously casting by continuously feeding molten metal to a mold through an immersion nozzle and drawing a cast product from a lower end of the mold, characterized in that a static magnetic field device is arranged in the mold to excite a static magnetic filed between the immersion nozzle and an inner wall face of the mold and molten metal is fed through the immersion nozzle wherein at least one portion of reduced sectional area of passage for molten metal is formed in the immersion nozzle near to the bottom of the nozzle and plural discharge ports symmetrically arranged with respect to a longitudinal axis of the nozzle are arranged above and below the sectional area reducing portion in the longitudinal direction of the nozzle, wherein a total sectional area of said discharge ports is not less than twice the sectional area of said molten steel passage.

* * * * *